US011499269B2

(12) United States Patent
Pande et al.

(10) Patent No.: US 11,499,269 B2
(45) Date of Patent: Nov. 15, 2022

(54) METHOD FOR PRODUCTION OF FILLER LOADED SURFACE ENHANCED PULP FIBERS

(71) Applicant: Domtar Paper Company, LLC, Fort Mill, SC (US)

(72) Inventors: Harshad Pande, Pointe-Claire (CA); Bruno Marcoccia, Charlotte, NC (US)

(73) Assignee: Domtar Paper Company LLC, Fort Mill, SC (US)

( * ) Notice: Subject to any disclaimer, the term of this patent is extended or adjusted under 35 U.S.C. 154(b) by 0 days.

(21) Appl. No.: 15/787,147

(22) Filed: Oct. 18, 2017

(65) Prior Publication Data

US 2018/0105986 A1 Apr. 19, 2018

Related U.S. Application Data

(60) Provisional application No. 62/409,666, filed on Oct. 18, 2016.

(51) Int. Cl.

| | |
|---|---|
| ***D21H 11/20*** | (2006.01) |
| ***D21H 17/67*** | (2006.01) |
| ***D21H 25/00*** | (2006.01) |
| ***D21H 21/10*** | (2006.01) |
| ***D21D 1/20*** | (2006.01) |

(52) U.S. Cl.

CPC ..... *D21H 17/675* (2013.01); *D21D 1/20* (2013.01); *D21H 11/20* (2013.01); *D21H 21/10* (2013.01); *D21H 25/005* (2013.01)

(58) Field of Classification Search

None

See application file for complete search history.

(56) References Cited

U.S. PATENT DOCUMENTS

| | | | |
|---|---|---|---|
| 3,098,785 | A | 7/1963 | Meiler |
| 3,388,037 | A | 6/1968 | Asplund et al. |
| 3,708,130 | A | 1/1973 | Perry |
| 3,794,558 | A | 2/1974 | Back |
| 3,891,499 | A | 6/1975 | Kato et al. |
| 3,920,508 | A | 11/1975 | Yonemori |
| 3,966,543 | A | 6/1976 | Cayle et al. |

(Continued)

FOREIGN PATENT DOCUMENTS

| | | |
|---|---|---|
| AU | 2013305802 | 8/2012 |
| AU | 2015218812 | 8/2015 |

(Continued)

OTHER PUBLICATIONS

Applicant Initiated Interview Summary for U.S. Appl. No. 13/836,760, dated Sep. 27, 2017.

(Continued)

*Primary Examiner* — Jacob T Minskey

(74) *Attorney, Agent, or Firm* — Troutman Pepper Hamilton Sanders LLP

(57) ABSTRACT

The present invention relates to a method for preparing loaded paper pulp for use in the manufacture of paper or paper board. At least one process stream containing a plurality of unrefined pulp fibers and at least one process stream of at least one filler are combined in a refiner to form a loaded paper pulp composition having a plurality of surface enhanced pulp fibers that are loaded with particles of the at least one filler.

19 Claims, 3 Drawing Sheets

(56) References Cited

U.S. PATENT DOCUMENTS

| | | | | |
|---|---|---|---|---|
| 4,012,279 | A | 3/1977 | Selander et al. | |
| 4,054,625 | A | 10/1977 | Kozlowski et al. | |
| 4,247,362 | A | 1/1981 | Williams | |
| 4,635,864 | A | 1/1987 | Peterson et al. | |
| 4,895,019 | A | 1/1990 | Lehmikangas et al. | |
| 5,110,412 | A | 5/1992 | Fuentes et al. | |
| 5,248,099 | A | 9/1993 | Lahner et al. | |
| 5,308,449 | A | 5/1994 | Fuentes et al. | |
| 5,695,136 | A | 12/1997 | Rohden et al. | |
| 5,731,080 | A | 3/1998 | Cousin et al. | |
| 5,824,364 | A | 10/1998 | Cousin et al. | |
| 5,954,283 | A | 9/1999 | Matthew | |
| 6,156,118 | A | 12/2000 | Silenius | |
| 6,165,317 | A | 12/2000 | Sabourin | |
| 6,251,222 | B1 | 6/2001 | Silenius et al. | |
| 6,296,736 | B1 | 10/2001 | Hsu et al. | |
| 6,375,974 | B1 | 4/2002 | Ito et al. | |
| 6,599,391 | B2 | 7/2003 | Silenius et al. | |
| 6,773,552 | B1 | 8/2004 | Albert et al. | |
| 6,861,380 | B2 | 3/2005 | Garnier et al. | |
| 6,887,350 | B2 | 5/2005 | Garnier et al. | |
| 6,935,589 | B1 | 8/2005 | Matthew | |
| 6,946,058 | B2 | 9/2005 | Hu | |
| 6,955,309 | B2 | 10/2005 | Matthew et al. | |
| 7,381,294 | B2 | 6/2008 | Suzuki et al. | |
| 7,624,879 | B2 | 12/2009 | Frances | |
| 7,741,234 | B2 | 6/2010 | Smith et al. | |
| 7,942,964 | B2 | 5/2011 | Luo et al. | |
| 8,871,057 | B2 * | 10/2014 | Gane | D21H 17/68 162/181.1 |
| 9,879,361 | B2 | 1/2018 | Pande et al. | |
| 9,920,484 | B2 | 3/2018 | Marcoccia et al. | |
| 9,988,762 | B2 | 6/2018 | Bilodeau et al. | |
| 10,563,356 | B2 | 2/2020 | Marcoccia et al. | |
| 10,704,165 | B2 | 7/2020 | Pande et al. | |
| 10,710,930 | B2 | 7/2020 | Marcoccia et al. | |
| 2002/0059886 | A1 | 5/2002 | Merkley et al. | |
| 2002/0069791 | A1 | 6/2002 | Merkley et al. | |
| 2002/0084046 | A1 | 7/2002 | Hsu et al. | |
| 2003/0111197 | A1 | 6/2003 | Hu | |
| 2004/0112558 | A1 | 6/2004 | Garnier et al. | |
| 2004/0112997 | A1 | 6/2004 | Matthew et al. | |
| 2004/0149403 | A1 * | 8/2004 | Rheims | D21D 1/20 162/9 |
| 2004/0180184 | A1 | 9/2004 | Fillion et al. | |
| 2004/0241350 | A1 | 12/2004 | Koga et al. | |
| 2005/0194477 | A1 | 9/2005 | Suzuki | |
| 2006/0006264 | A1 | 1/2006 | Sabourin et al. | |
| 2007/0164143 | A1 | 7/2007 | Sabourin et al. | |
| 2008/0148999 | A1 | 6/2008 | Luo et al. | |
| 2008/0227161 | A1 | 9/2008 | Levie et al. | |
| 2009/0145562 | A1 | 6/2009 | Nguyen | |
| 2009/0145842 | A1 | 6/2009 | Frances | |
| 2009/0162602 | A1 | 6/2009 | Cottier et al. | |
| 2009/0221812 | A1 | 9/2009 | Ankerfors et al. | |
| 2009/0266500 | A1 | 10/2009 | Schubert et al. | |
| 2010/0065236 | A1 | 3/2010 | Henriksson et al. | |
| 2010/0218908 | A1 | 9/2010 | Silenius et al. | |
| 2010/0288456 | A1 | 11/2010 | Westland et al. | |
| 2011/0277947 | A1 | 11/2011 | Hua et al. | |
| 2011/0314726 | A1 | 12/2011 | Jameel et al. | |
| 2012/0007363 | A1 | 1/2012 | Wang | |
| 2012/0012031 | A1 | 1/2012 | Husband et al. | |
| 2013/0202870 | A1 | 8/2013 | Malmborg et al. | |
| 2014/0057105 | A1 | 2/2014 | Pande et al. | |
| 2014/0116635 | A1 | 5/2014 | Porto et al. | |
| 2014/0180184 | A1 | 6/2014 | Duguid | |
| 2014/0209260 | A1 | 7/2014 | Li et al. | |
| 2014/0209264 | A1 | 7/2014 | Tirimacco et al. | |
| 2014/0302117 | A1 | 10/2014 | Moen et al. | |
| 2015/0299955 | A1 | 10/2015 | Laukkanen et al. | |
| 2016/0333524 | A1 | 11/2016 | Pande et al. | |
| 2016/0340802 | A1 | 11/2016 | Pande et al. | |
| 2017/0058457 | A1 | 3/2017 | Marcoccia et al. | |
| 2017/0073893 | A1 | 3/2017 | Bilodeau et al. | |
| 2017/0226009 | A1 | 8/2017 | Marcoccia et al. | |
| 2018/0105986 | A1 | 4/2018 | Harshad et al. | |
| 2018/0148895 | A1 | 5/2018 | Marcoccia et al. | |
| 2019/0218716 | A1 | 7/2019 | Hoglund et al. | |
| 2019/0242062 | A1 | 8/2019 | Harshad et al. | |
| 2020/0063353 | A1 | 2/2020 | Everett et al. | |
| 2020/0308769 | A1 | 10/2020 | Pande et al. | |
| 2020/0325629 | A1 | 10/2020 | Marcoccia et al. | |
| 2020/0340155 | A1 | 10/2020 | Pande et al. | |

FOREIGN PATENT DOCUMENTS

| | | |
|---|---|---|
| CA | 2883161 | 2/2014 |
| CN | 1516768 | 7/2004 |
| CN | 103590283 | 7/2004 |
| CN | 1718914 | 1/2006 |
| CN | 101691700 | 4/2010 |
| CN | 102971462 | 3/2013 |
| EP | 0333209 | 9/1989 |
| EP | 0333212 | 9/1989 |
| EP | 2220291 | 5/2017 |
| FR | 2520769 | 8/1983 |
| JP | S58-136895 | 8/1983 |
| JP | H02229747 | 9/1990 |
| JP | H03122038 | 5/1991 |
| JP | H04194097 | 7/1992 |
| JP | H 04263699 | 9/1992 |
| JP | H07165456 | 6/1995 |
| JP | H08197836 | 8/1996 |
| JP | H08284090 | 10/1996 |
| JP | H09-124950 | 5/1997 |
| JP | 2002194691 | 7/2002 |
| JP | 2004525284 | 8/2004 |
| JP | 2004360088 | 12/2004 |
| JP | 2007231438 | 9/2007 |
| JP | 2010125694 | 6/2010 |
| JP | 2012526923 | 11/2012 |
| JP | 2015526608 | 9/2015 |
| JP | 2018135631 | 8/2018 |
| KR | 2004/0022874 | 3/2004 |
| KR | 1020050086850 | 8/2005 |
| KR | 10-0662043 B | 12/2006 |
| KR | 10-2010-0090745 | 8/2010 |
| KR | 1020130132381 | 12/2013 |
| RU | 2224060 | 2/2004 |
| RU | 2309211 | 10/2007 |
| RU | 2358055 | 6/2009 |
| WO | WO 96/04424 | 2/1996 |
| WO | WO 98/23814 | 6/1998 |
| WO | WO 02/14606 | 2/2002 |
| WO | WO 2002/095129 | 11/2002 |
| WO | WO 2004/101889 | 11/2004 |
| WO | WO 2009/038730 | 3/2009 |
| WO | WO 2009/155541 | 12/2009 |
| WO | WO 2010/134868 | 11/2010 |
| WO | WO 2012/007363 | 1/2012 |
| WO | WO 2012/101331 | 8/2012 |
| WO | WO 2014/031737 | 2/2014 |
| WO | WO 2014/106684 | 7/2014 |
| WO | WO 2015/127233 | 8/2015 |
| WO | WO 2015/127239 | 8/2015 |
| WO | WO 2018/026804 | 2/2018 |
| WO | WO 2018/051275 | 3/2018 |
| WO | WO 2019/152969 | 8/2019 |

OTHER PUBLICATIONS

Applicant Initiated Interview Summary for U.S. Appl. No. 13/836,760, dated May 9, 2017.

Extended European Search Report issued in European Application No. 17195921.6, dated Nov. 20, 2017.

Final Office Action issued in U.S. Appl. No. 13/836,760, dated May 12, 2016.

Final Office Action issued in U.S. Appl. No. 13/838,760, dated Jan. 27, 2017.

Handbook of Pulping and Papermaking, C. Biermann, Academic Press; 2nd Edition (Aug. 5, 1996), p. 145.

(56) References Cited

OTHER PUBLICATIONS

Intention to grant for European patent No. 13759601.1, dated Jul. 25, 2017.
International Preliminary Report on Patentability for PCT Application No. PCT/US2015/016865, dated Aug. 23, 2016.
International Preliminary Report on Patentability for PCT Application No. PCT/US2015/016858, dated Aug. 23, 2016.
International Preliminary Report on Patentability for PCT Application No. PCT/US2013/055971, dated Feb. 24, 2015.
International Search Report and Written Opinion for PCT Application No. PCT/US2015/016865, dated May 20, 2015.
International Search Report and Written Opinion for PCT Application No. PCT/US2015/016858, dated May 15, 2015.
International Search Report and Written Opinion for PCT Application No. PCT/US2013/055971, dated Oct. 24, 2013.
International Search Report and Written Opinion issued in International Application No. PCT/US17/44881, dated Oct. 18, 2017.
La Vrykova-Marrain et al., "Characterizing the drainage resistance of pulp and microfibrillar suspensions using hydrodynamic flow measurements," TAPPI's PaperCon 2012 Conference.
Non-Final Office Action for U.S. Appl. No. 13/836,760, dated Oct. 15, 2015.
Non-Final Office Action issued in U.S. Appl. No. 15/120,220, dated Jul. 13, 2017.
Notice of Acceptance for Australian Application No. 2013305802, dated Apr. 21, 2017.
Notice of Acceptance for New Zealand Application No. 705191, dated Apr. 13, 2017.
Notice of Allowance for Canadian Patent Application No. 2,883,161, dated Jan. 3, 2017.
Notice of Allowance for U.S. Appl. No. 15/120,220, dated Nov. 6, 2017.
Notice of Grant for Chinese Application No. 201380054919.2, , dated Nov. 14, 2017.
Pal et al., "A Simple Method for Calculation of the Permeability Coefficient of Porous Media," TAPPI Journal, 5(9):10-16, (2006).
Restriction Requirement for U.S. Appl. No. 13/836,760, dated Jul. 16, 2015.
Teixeira, "Recycled Old Corrugated Container Fibers for Wood-Fiber Cement Sheets," International Scholarly Research Network 2012(923413): 1-8, 2012.
Tonoli et al., "Effect of Fibre morphology on flocculation of fibre-cement suspensions," Cement and Concrete Research, 39:1017-1022, (2009).
International Search Report and Written Opinion Issued in PCT Application No. PCT/US2017/057161, dated Dec. 22, 2017.
Notice of Allowance Issued in Chinese Patent Application No. 201580020488.7, dated Apr. 12, 2018.
Office Action Issued in Japanese Application No. 148632, dated Apr. 10, 2018.
Demuner et al., "Ultra low intensity refining of eucalyptus pulps." Scientific and technical advances in refining and mechanical pulping 2005.
Joy et al., "Ultra-Low intensity refining of short fibered pulps." African Pulp and Paper Week 2004 retrieved from URL:< https://www.tappsa.eo.za/archive2/APPW_2004/Title2004/Ultra-low_intensity_refining/ultra-low_intensity_refining.html >.
Office Action issued in corresponding European Patent No. 17195921 dated Apr. 17, 2019.
Declaration of Harshad Pande and Bruno Marcoccia, filed in U.S. Appl. No. 13/836,760, dated Oct. 12, 2016.
Notice of Reasons for Refusal issued in Japanese Patent Application No. 2018-090071, dated May 15, 2019.
Office Action issued in Indian Patent Application No. 465/KOLNP/2015, dated May 7, 2019.
Office Action issued in Russian Patent Application No. 2018125883/12, dated Mar. 6, 2019.
International Search Report and Written Opinion issued in International Patent Application No. PCT/US2019/016590, dated May 23, 2019.
Carvalho, et al., "A Comparative Study for Two Automated Techniques for Measuring Fiber Length," *Tappi Journal, Technical Association of The Pulp & Paper Industry*, 80(2): 137-142, 1997.
Office Action Issued in Corresponding Chinese Patent Application No. 201810081469.0, dated Jan. 21, 2020.
Brazilian Search Report Issued in Corresponding Brazilian Patent Application No. BR112015003819-0, dated Sep. 9, 2019.
Office Action Issued in Corresponding Korean Patent Application No. 10-2015-7006955, dated May 29, 2020.
Pala et al., "Refining and enzymatic treatment of secondary fibres for paperboard production: Cyberflex measurements of fibre flexibility" COST E20—Wood Fibre Cell Wall Structure 2001, 4 pages.

* cited by examiner

METHOD FOR PRODUCTION OF FILLER LOADED SURFACE ENHANCED PULP FIBERS

CROSS-REFERNCE TO RELATED APPLICATION

This application claims the benefit of U.S. Provisional Application No. 62/409,666 filed Oct. 18, 2016, the application being incorporated by reference herein in its entirety.

FIELD

The present invention relates generally to the process of preparing surface enhanced pulp fibers loaded with at least one filler, and more particularly, to increasing the deposition and retention of these fillers in surface enhanced pulp fibers for the subsequent manufacture of paper or paperboard products.

BACKGROUND

Inorganic material such as precipitated calcium carbonate (PCC) ground calcium carbonate (GCC), clay and talc are used extensively as fillers in the paper making process. Filler loading levels of 12-25% are typical in current paper making strategy to improve optical properties of the paper such as brightness and opacity. In some instances, the economics of substituting expensive fiber with inexpensive filler lends added incentive.

To insure that the fillers remain with the fiber web and ultimately with the paper product, retention aids are commonly used. Such exemplary conventional retention aids include long chained polymeric compounds that are used to flocculate the furnish and enhance the "filler-fiber" attachment. However, it is known that high flocculation levels can lead to non-uniformity in the fiber web and poor paper formation.

To circumvent this non-uniformity issue, a method to attach the filler directly on to the fiber surfaces is described in U.S. Pat. Nos. 5,731,080 and 5,824,364 to Cousin et al. In these patents, a slip stream of pulp furnish is refined to low freeness (<70 Canadian standard freeness [csf) versus the typical 450 scf) and is then treated to generate a highly loaded filler-fiber complex, which is then recombined with untreated pulp to produce a desirable filler level.

An alternative approach is described in U.S. Pat. No. 5,679,220 to Matthew et al. and U.S. Pat. No. 5,665,205 to Srivatsa et al, in which the entire furnish is treated with nominal filler loadings without subjecting the pulp to high refining levels (low freeness). However, this procedure results in increases in capital and operating costs due to the treatment of larger pulp volumes.

It is also known in the art to produce fiber-filler complexes by contacting a fiber slurry with slaked lime and carbon dioxide gas to precipitate calcium carbonate (PCC). Such processes include a batch reaction process for obtaining a fiber-based composite produced by precipitating calcium carbonate in situ in an aqueous suspension of fibers of expanded surface area having microfibrils on their surface. In this batch reaction process, the crystals of precipitated calcium carbonate (PCC) are organized essentially in clusters of granules directly grafted on to the microfibrils without any binders or retention aids such that the crystals trap the microfibrils by reliable and non-labile bonding. It is believed that the complexing process relies on anionic charges located on the fiber surfaces that act as nucleation sites to anchor the calcium carbonate crystal on to the fiber. The precipitating calcium carbonate physically binds on to the fiber at these sites.

Accordingly, there is a need in the art to generate filler-fiber complexes easily and inexpensively. The present invention provides for a source of highly fibrillated fiber having a high surface area (anchoring sites) that allows for the loading of the refined fibers to a desired and consistent level with at least one filler during a refining operation.

SUMMARY

Described herein is a method of making a loaded paper pulp composition for use in the manufacture of paper products having desired/improved printing characteristics, and particularly to a loaded paper pulp composition comprising highly fibrillated surface enhanced pulp fibers that are integrally entangled and/or loaded with at least one filler. In one aspect, one property of the highly fibrillated surface enhanced pulp fibers disclosed herein is their ability to significantly increase fiber bonding. It is contemplated that the strength enhancing properties of the surface enhanced pulp fibers can be utilized to increase the physical properties of the produced paper product and the use of the filler can be utilized to reduce the cost of the loaded paper pulp composition while maintaining the desired strength enhancing properties of the surface enhanced pulp fibers.

In one aspect, a loaded paper pulp composition for use in the manufacture of paper products can be produced by concurrently introducing a first process stream containing a plurality of unrefined wood pulp fibers into a refiner and a second process stream containing at least one filler into a refiner, which can be hardwood, softwood, or a combination of hardwood and softwood pulp fibers, into the refiner. It is contemplated that the loaded paper pulp composition can be formed at desired ratios of the selected filler and surface enhanced wood pulp fibers. A resulting paper comprising the loaded paper pulp composition can exhibit enhanced stiffness properties, enhanced filler retention and has more uniform z- and cross direction filler profiles.

The refined surface enhanced pulp fibers can have, for example, a length weighted average fiber length of at least about 0.2 millimeters, at least about 0.3 millimeters, or at least about 0.4 millimeters and an average hydrodynamic specific surface area of at least about 10 square meters per gram or at least about 12 square meters per gram after being refined in a mechanical refiner having a pair of ultrafine refiner plates at a specific edge load of less than 0.2 Ws/m until an energy consumption of at least 300 kWh/ton is reached. The length weighted average length of the formed surface enhanced pulp fibers can be, for example, at least 60%, or optionally, 70%, of the length weighted average length of the fibers prior to introduction into the mechanical refiner. The increased average fiber length and increase surface area of each of the surface enhanced pulp fibers increases the available sites for entanglement/bonding of the filler and the surface enhanced pulp fibers relative to the each other.

In accordance with the present invention, the surface enhanced pulp fibers can comprise wood pulp refined with an energy input of at least 300 kwh/t and preferably between about 400 to about 1,800 kwh/t. In this aspect, it is contemplated that the number of surface enhanced pulp fibers can be at least 12,000 fibers/milligram on an oven-dry basis. In another aspect, the surface enhanced pulp fibers can have an average hydrodynamic specific surface area that can be at least 4 times greater or at least 6 time greater than the average specific surface area of the unrefined wood pulp fibers prior to introduction into the refiner for fibrillation.

In another aspect, the at least one filler can comprise a plurality of crystals of calcium carbonate, CaCO3 (PCC). In this aspect, it is contemplated that the plurality of crystals of PCC can be directly entangled therein the plurality of surface enhanced pulp fibers by mechanical bonding, without binders or retention aids present at the interface between the crystals of PCC and the formed surface enhanced pulp fibers.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
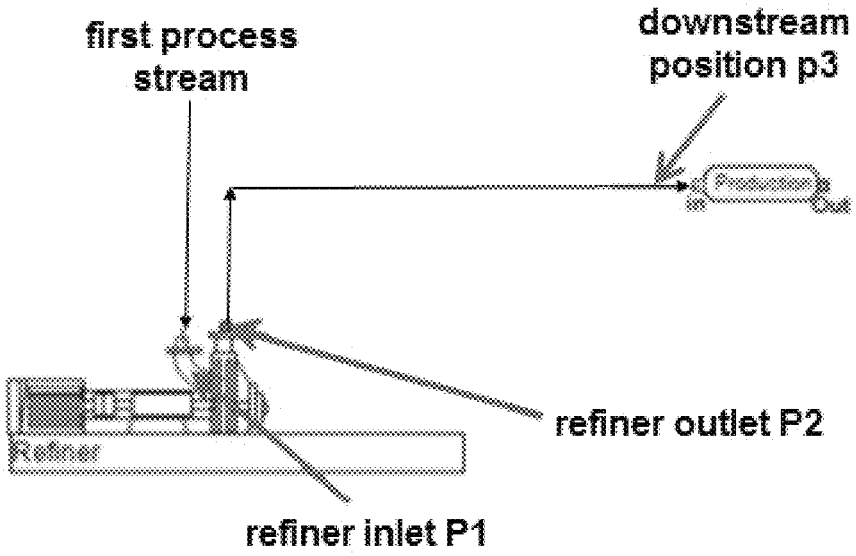
FIG. 1 is a schematic block diagram illustrating a system for making a loaded paper pulp composition according to the present invention.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. It will also be apparent that the various aspects of the invention described herein may be added to other existing measurement devices/systems as an embodiment of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a refiner" can include two or more such refiners unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

Disclosed herein are surface enhanced pulp fibers that are loaded with at least one filler and a method for loading surface enhanced pulp fibers with at least one filler. In general, the invention provides an improved process for increasing the deposition and retention of particulate fillers on highly fibrillated surface enhanced pulp fibers for the manufacture of paper, paperboard products and the like. In one exemplary aspect, the fillers can comprise precipitated calcium carbonate (PCC). However, it is also contemplated that other particulate filler, such as, for example and without limitation, talc, clay, silica based pigments, aluminum based pigments, and the like, may be added to the surface enhanced pulp fibers.

Disclosed herein are methodologies for the production of a loaded paper pulp composition for use in the manufacture of paper products. In this aspect, the loaded paper pulp composition can comprise a plurality of highly fibrillated surface enhanced pulp fibers that has at least one filler entangled/mechanically bonded to the exterior surface of the plurality of surface enhanced pulp fibers at a desired weight percentage. In a further aspect, the distribution of filler can be substantially uniform across the plurality of surface enhanced pulp fibers in the formed loaded paper pulp composition.

In one example, the loaded paper pulp composition can be formed by introducing a first process stream containing a plurality of unrefined wood pulp fibers into a refiner and introducing a second process stream containing at least one filler into the refiner. The first and second process steams can be introduced into the refiner concurrently, or optionally, at respective desired timed intervals for the first and second process streams. As noted above, it is contemplated that the loaded paper pulp composition can be formed at desired ratios of the selected filler and unrefined wood pulp fibers.

In various aspects, the ratio of highly fibrillated surface enhanced pulp fibers to at least one filler present in the loaded paper pulp composition can be about 1:5, preferably about 1:3, and most preferably about 1:1. It is contemplated that additional at least one filler can be subsequently added, in combination with the loaded paper pulp composition, downstream in the paper production process on a weight basis to produce a paper product having a desired filler weight percentage.

Optionally, it is contemplated that the first and second process steams can be combined at: i) an inlet of the refiner (in which unrefined pulp fibers are combined with the at least one filler for subsequent concurrent refining to form the loaded paper pulp composition having the desired ratios of the selected filler and surface enhanced pulp fibers); ii) an outlet of the refiner (in which formed surface enhanced pulp fibers are combined with the at least one filler to form the loaded paper pulp composition having the desired ratios of the selected filler and surface enhanced pulp fibers), or iii) downstream of the refiner and prior to the introduction of the formed surface enhanced pulp fibers into a paper product production process (in which formed surface enhanced pulp fibers are combined with the at least one filler to form the loaded paper pulp composition having the desired ratios of the selected filler and surface enhanced pulp fibers). The contemplated combinations of the first and second process streams allow for the mechanical deposition and entanglement of the selected filler in situ on the fibrils of the highly fibrillated surface enhanced pulp fibers without requiring the addition of an aqueous element, such as, for example and without limitation, water.

Optionally, a first percentage of the at least one filler can be introduced via the second process stream into the refiner at an inlet of the refiner, in which the unrefined pulp fibers that are introduced into the refiner via the first process stream are combined with the first percentage of the at least one filler for subsequent concurrent refining to form the loaded paper pulp composition having a first desired ratio of the at least one filler and the plurality of surface enhanced pulp fibers. Subsequently, a second percentage of the at least one filler can be added downstream of the refiner and prior to the introduction of the loaded paper pump composition into a conventional refined pulp tank (which is typically prior to the introduction of the formed loaded paper pump composition into a paper product production process). This optional methodology allows for the selective increase of the relative weight percentage of the at least one filler in the loaded paper pulp composition to a final desired ratio of the at least one filler and the plurality of surface enhanced pulp fibers.

In another aspect, the at least one filler can comprise a plurality of crystals of calcium carbonate, CaCO3 (PCC). In this aspect, it is contemplated that the plurality of crystals of PCC can be directly entangled therein the surface enhanced pulp fibers by mechanical bonding, without binders or retention aids present at the interface between said crystals of PCC and the formed surface enhanced pulp fibers. The plurality of crystals of calcium carbonate can have an average particle size of between about 0.05 micron to 10 micron, preferably between about 0.1 micron to 5 micron, and most preferred between about 0.5 micron to 3.0 micron.

Embodiments of the present invention relate generally to a loaded paper pulp composition comprising surface enhanced pulp fibers, methods for producing the loaded paper pulp composition comprising surface enhanced pulp fibers, and products incorporating loaded paper pulp composition comprising surface enhanced pulp fibers. The surface enhanced pulp fibers present in the loaded paper pulp composition are fibrillated to an extent that provides desirable properties as set forth below and may be characterized as being highly fibrillated. In various embodiments, the surface enhanced pulp fibers described herein have significantly higher surface areas without significant reductions in fiber lengths, as compared to conventional refined fibers, and without a substantial amount of fines being generated during fibrillation. Such surface enhanced pulp fibers, with their significantly higher surface areas without significant reductions in fiber lengths, can be useful in the uniform loading of fillers in the loaded paper pulp composition without the necessary use of binders or retention.

The pulp fibers that can be surface enhanced according to embodiments of the present invention can originate from a variety of wood types, including hardwood and softwood. Non-limiting examples of hardwood pulp fibers that can be used in some embodiments of the present invention include, without limitation, oak, gum, maple, poplar, eucalyptus, aspen, birch, and others known to those of skill in the art. Non-limiting examples of softwood pulp fibers that can be used in some embodiments of the present invention include, without limitation, spruce, pine, fir, hemlock, southern pine, redwood, and others known to those of skill in the art. The pulp fibers may be obtained from a chemical source (e.g., a Kraft process, a sulfite process, a soda pulping process, etc.), a mechanical source, (e.g., a thermomechanical process (TMP), a bleached chemi-thermomechanical process (BCTMP), etc.), or combinations thereof. The pulp fibers can also originate from non-wood fibers such as linen, cotton, bagasse, hemp, straw, kenaf, etc. The pulp fibers can be bleached, partially bleached, or unbleached with varying degrees of lignin content and other impurities. In some aspects, the pulp fibers can be recycled fibers or post-consumer fibers.

The plurality of surface enhanced pulp fibers can be characterized according to various properties and combinations of properties including, for example, length, specific surface area, change in length, change in specific surface area, surface properties (e.g., surface activity, surface energy, and the like), percentage of fines, drainage properties (e.g., Schopper-Riegler), crill measurement (fibrillation), water absorption properties (e.g., water retention value, wicking rate, and the like), and various combinations thereof. While the following description may not specifically identify each of the various combinations of properties, it will be understood by one skilled in the art that different surface enhanced pulp fibers may possess one, more than one, or all of the properties described herein.

In various exemplary aspects, the surface enhanced pulp fibers can have a length weighted average fiber length of at least about 0.2 millimeters, at least about 0.3 millimeters, or at least about 0.4 millimeters and an average hydrodynamic specific surface area of at least about 10 square meters per gram or, more preferred, at least about 12 square meters per gram. In one non-limiting example, the surface enhanced pulp fibers are formed by being fibrillated in a mechanical refine at a specific edge load of less than 0.2 Ws/m until an energy consumption of at least 450 kWh/ton is reached. As used herein, "specific edge load" (or SEL) is a term understood to those of ordinary skill in the art to refer to the quotient of net applied power divided by the product of rotating speed and edge length. SEL is used to characterize the intensity of refining and is expressed as Watt-second/meter (Ws/m).

In a further aspect, it is contemplated that the number of surface enhanced pulp fibers can be at least 12,000 fibers/milligram on an oven-dry basis. As used herein, "oven-dry basis" means that the sample is dried in an oven set at 105° C. for 24 hours.

As used herein, the length weighted average length is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer.

The surface enhanced pulp fibers production methodology allows for the preservation of the lengths of the fibers during the fibrillation process. In some aspects, the plurality of surface enhanced pulp fibers can have a length weighted average length that is at least 60% of the length weighted average length of the fibers prior to fibrillation. A plurality of surface enhanced pulp fibers, according to optional aspects, can have a length weighted average length that is at least 70% of the length weighted average length of the fibers prior to fibrillation.

In a further aspect, the surface enhanced pulp fibers of the present invention advantageously have large hydrodynamic specific surface areas which can be useful in some applications, such the paper making process described herein. As noted above, the surface enhanced pulp fibers can have an average hydrodynamic specific surface area of at least about 10 square meters per gram, and more preferably at least about 12 square meters per gram. For illustrative purposes, a typical unrefined papermaking fiber would generally have a hydrodynamic specific surface area of about 2 m2/g. Further, a typical fiber that is refined conventional to a low energy, such as less than 60 kwh/t or less than 100 kwh/t, would generally have a hydrodynamic surface area that is less than a surface enhanced pulp fiber. As used herein, hydrodynamic specific surface area is measured pursuant to the procedure specified in Characterizing the Drainage Resistance of Pulp and Microfibrillar Suspensions using Hydrodynamic Flow Measurements, N. Lavrykova-Marrain and B. Ramarao, TAPPI's PaperCon 2012 Conference, available at http://www.tappi.org/Hie/Events/12PaperCon/Papers/12PAP116.aspx, which is hereby incorporated herein in its entirety by reference.

The hydrodynamic specific surface areas of the surface enhanced pulp fibers are significantly greater than that of the fibers prior to fibrillation. In some aspects, the plurality of surface enhanced pulp fibers can have an average hydrodynamic specific surface area that is at least 4 times greater than the average specific surface area of the fibers prior to fibrillation, preferably at least 6 times greater than the average specific surface area of the fibers prior to fibrillation, and most preferably at least 8 times greater than the average specific surface area of the fibers prior to fibrillation.

As noted above, the surface enhanced pulp fibers used herein advantageously have increased hydrodynamic specific surface areas while preserving fiber lengths. It has been noted that the effective increase in the hydrodynamic specific surface area can provide for increased fiber bonding, absorbing water or other materials, retention of organics, higher surface energy, and other positive effects.

In the refinement of pulp fibers to provide surface enhanced pulp fibers, some aspects preferably minimize the generation of fines. As used herein, the term "fines" is used to refer to pulp fibers having a length of 0.2 millimeters or less. In some aspects, surface enhanced pulp fibers can have a length weighted fines value of less than 40%, more preferably less than 22%, with less than 20% being most preferred. As used herein, "length weighted fines value" is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer.

In one aspect, the surface enhanced pulp fibers present in the loaded paper pulp composition have a preserved length and relatively high specific surface area without generation of a large number of fines during the production of the surface enhanced pulp fibers. Further, the surface enhanced pulp fibers can simultaneously possess one or more of the following properties: length weighted average fiber length; change in average hydrodynamic specific surface area; and/or surface activity properties. It is contemplated that such surface enhanced pulp fibers can minimize the negative effects on drainage while also retaining or improving the strength of products in which they are incorporated.

In one embodiment, a method for producing the loaded paper pulp composition for use in the manufacture of paper products and the like can comprise introducing a first process stream containing a plurality of unrefined hardwood pulp fibers into an inlet of a mechanical refiner and a second process stream containing at least one filler into the inlet of the refiner and refining the at least one filler and the pulp fibers until an energy consumption of at least 300 kWh/ton is reached by the refiner to produce the loaded paper pulp composition. Optionally, the introduction of the respective first and second process streams can be done concurrently or in a desired sequence to ensure the proper by weight loading of filler to wood fiber so that the finished loaded paper pump composition which comprises has a desired level of filler loading.

In a further embodiment, a method for producing the loaded paper pulp composition for use in the manufacture of paper products and the like can comprise introducing a first process stream of a plurality of unrefined pulp fibers into a refiner and refining the plurality of unrefined pulp fibers in a refiner having at a specific edge load of less than 0.2 Ws/m until an energy consumption of at least 300 kWh/ton is reached to form a plurality of surface enhanced pulp fibers. In this aspect, the refiner can have a pair of refiner plates that have a bar width of 1.0 millimeters or less and a groove width of 1.6 millimeters or less. The formed surface enhanced pulp fibers can have a length-weighted average fiber length of at least about 0.3 millimeters and an average hydrodynamic specific surface area of at least about 10 square meters per gram. Further, it is contemplated that the length weighted average length of the formed surface enhanced pulp fibers is at least 60% of the original length weighted average length of the unrefined pulp fibers prior to fibrillation. Subsequently, a second process stream containing at least one filler can be introduced into the plurality of surface enhanced pulp fibers to form the loaded paper pulp composition. It is contemplated in this aspect that the at least one filler can be substantially uniformly distributed in the plurality of surface enhanced pulp fibers in the formed loaded paper pulp composition.

In one aspect, the refiner can comprise a pair of refiner plates, in which each refiner plate can have a bar width of 1.3 millimeters or less and a groove width of 2.5 millimeters or less. Optionally, the refiner plates can have a bar width of 1.0 millimeters or less and a groove width of 1.6 millimeters or less, or a bar width of 1.0 millimeters or less and a groove width of 1.3 millimeters or less. Conventional plates (e.g., bar widths of greater than 1.3 millimeters and/or groove widths of greater than 2.0 millimeters) and/or improper operating conditions can significantly negatively enhance fiber cutting in the pulp fibers and/or generate an undesirable level of fines.

The desired plurality of surface enhanced pulp fibers in the loaded paper pulp composition can be produced by fibrillating the pulp fibers at a low specific edge load until the desired energy consumption is reached. It is contemplated that the refiner can be operated at a specific edge load between about 0.1 and about 0.3 Ws/m, preferably at a specific edge load between about 0.1 and about 0.2 Ws/m, and most preferably at a specific edge load of less than 0.2 Ws/m. Specific edge load (or SEL) is a term understood to those of ordinary skill in the art to refer to the quotient of net applied power divided by the product of rotating speed and edge length. SEL is used to characterize the intensity of refining and is expressed as Watt-second/meter (Ws/m).

Optionally, the pulp fibers, and the at least one filler if added to the refiner, forming the loaded paper pulp composition can be refined until an energy consumption of at least 350 kWh/ton is reached, at least 400 kWh/ton is reached, at least 450 kWh/ton is reached, at least 500 kWh/ton is reached, at least 550 kWh/ton is reached, at least 600 kWh/ton is reached, at least 700 kWh/ton is reached, or at least 750 kWh/ton is reached. As used herein and as understood by those of ordinary skill in the art, the references to energy consumption or refining energy herein utilize units of kWh/ton with the understanding that "/ton" or "per ton" refers to ton of pulp passing through the refiner on a dry basis.

It is contemplated that the loaded paper pulp composition can be produced by refining pulp fibers through the one or more refiners, sequentially, until the desired energy consumption is reached. In one aspect, the pulp fibers and the filler forming the loaded paper pulp composition can be recirculated in the refiner until the desired energy consumption is reached. In one exemplary aspect, the refiner can be operated at lower refining energies per pass (e.g., 100 kWh/ton/pass or less) such that multiple passes or multiple sequential refiners are needed to provide the specified desired refining energy consumption. For example, a single refiner can operate at 50 kWh/ton/pass, and the pulp fibers can be recirculated through the refiner for a total of 9 passes to provide 450 kWh/ton of applied refining energy consumption.

EXAMPLE 1

Filler Enhanced Fibrils Trial

Procedure

Southern hardwood pulp was used and PCC was supplied at 20% solids. Referring to FIG. 1, PCC was added at a 1:1 ratio (1 part filler to 1 part fiber) at three different sites in the trail run: 1) directly before the refiner inlet (P1), 2) directly after the refiner outlet (P2), and 3) after the outlet valve to the refined pulp tank (P3). The Marlboro wood pulp was refined and fibrillated at nominal 300, 400, and 500 kwh/t energy levels in a 24" Beloit/GLV refiner operated at 1000 rpm. In the testing operation, the refining system uses recirculation (after the refiner back to the pump suction) to allow for the high energy and low flow that is required for producing the desired surface enhanced pulp fibers. In one aspect, the refining consistency was maintained at 4.4% pulp consistency prior to the filler addition. A plurality of control wood pulp fibers was also produced at 70 kwh/t.

Handsheets were made using the control wood pulp fibers and conventional recirculation and retention chemistry was used during the sheetmaking. A control sample was made at a 75/25 ratio of the control wood pulp fibers and PCC. This control sample was then compared with handsheets made for the various refining conditions (the 300, 400, and 500 kwh/t energy levels and the P1, P2, and P3 filler additive positions) using 50% of the control wood pulp fibers and 50% of the SEPF-Filler (1:1).

Table 1 and Table 2 below provide details of the experimental plan:

TABLE 1

PCC addition points for different trial conditions

| Trial | Target Specific Energy (KWh/t) | PCC addition Point |
|---|---|---|
| 23-C | 70 | none |
| 23-1 | 300 | P1 |
| 23-2 | 300 | P2 |
| 23-3 | 300 | P3 |
| 23-4 | 300 | P3 |
| 23-5 | 400 | P3 |
| 23-6 | 500 | P3 |
| 23-7 | 500 | P1 |
| 23-8 | 400 | P1 |
| 23-9 | 300 | P1 |

TABLE 2

Furnish blends for handsheet analysis

| Blends | Refine hardwood kraft (70 KWh/t), % | (SEPF + PCC) % |
|---|---|---|
| B-C | 75% 23-C | 0 + 25% |
| B-1 | 50% 23-C | (25% + 25%)23-1 |
| B-2 | 50% 23-C | (25% + 25%)23-2 |
| B-3 | 50% 23-C | (25% + 25%)23-3 |
| B-4 | 50% 23-C | (25% + 25%)23-4 |
| B-5 | 50% 23-C | (25% + 25%)23-5 |
| B-6 | 50% 23-C | (25% + 25%)23-6 |
| B-7 | 50% 23-C | (25% + 25%)23-7 |
| B-8 | 50% 23-C | (25% + 25%)23-8 |
| B-9 | 50% 23-C | (25% + 25%)23-9 |

Figure 2:
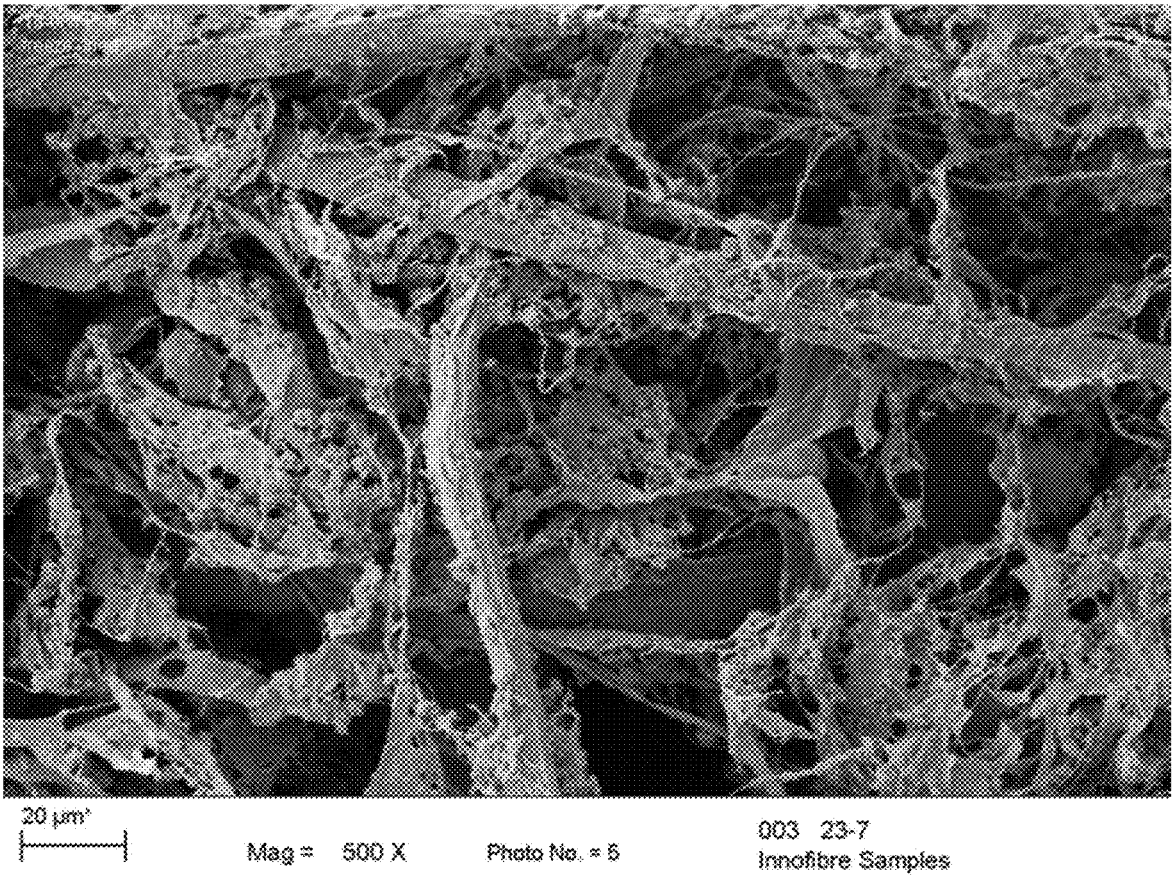
FIG. 2 is a magnified (500X) SEM picture showing a plurality of highly fibrillated surface enhanced pulp fibers that are integrally bonded and/or entangled with the filler particles of the at least one filler.

The mechanism of filler locking to the fibrils is shown in the SEM picture illustrated in FIG. 2.

Figure 3:
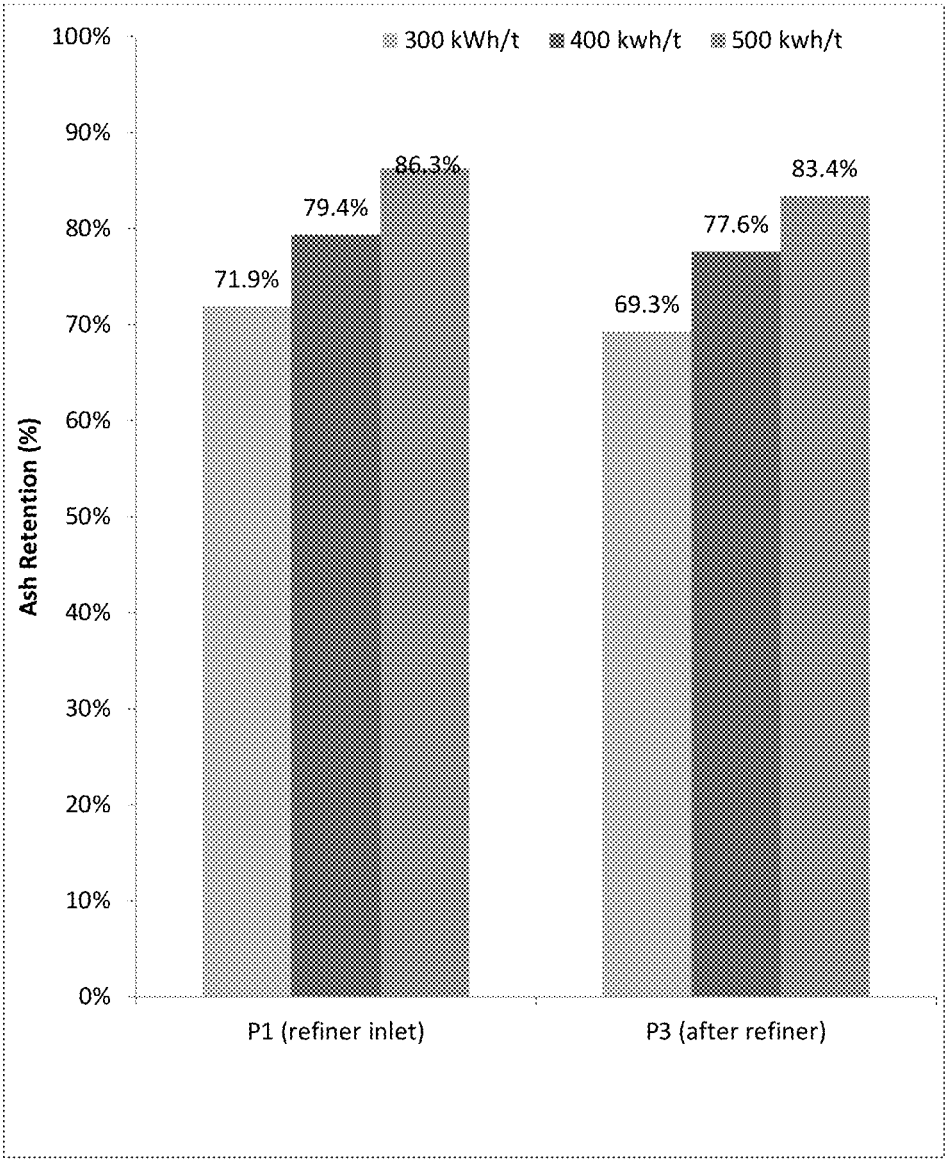
FIG. 3 is a table showing the ash retention relative to the addition point of the at least one filler in the production process of a loaded paper pulp composition.

Referring to Tables 1 and 2 above, the handsheet ash for B-C, was compared with B-6, and B-7. Ash retention being defined as (Handsheet Ash*100/Furnish Ash). As illustrated in FIG. 3, it was noted that the addition point P1, directly before the refiner inlet, corresponding to B-7 gave the highest ash retention of 86.2%, followed by addition point B-6, corresponding to addition point P3, after the outlet valve to the refined pulp tank, of 83.4%, while B-C with no surface enhanced pulp fibers was 81%.

There was higher retention of PCC with surface enhanced pulp fibers (SEPF) produced at a higher refining energy (which generally correlates to more fibrillation of the wood pulp fibers). Further, there was higher retention of PCC when the PCC is added at the inlet to the refiner and is mixed with the pulp fibers as they are being transformed into SEPF. This resulting increase in retention of PCC did not negatively impact formed handsheet strength.

For example, and referring to Table 3 below, comparing the handsheet properties at 400 KWh/t (SEPF) and PCC addition points of P1 and P3, directly before the refiner inlet and after the outlet valve to the refined pulp tank respectively, it was observed that addition point P1, directly before the refiner inlet, provides higher ash and the strength properties are either maintained or improved.

TABLE 3

Handsheet properties for two different points of addition of PCC

| | 400 kwh/t (refiner inlet, P1) | 400 kwh/t (after refiner, P3) |
|---|---|---|
| Blended Sheet Ash % | 24.5 | 21.6 |
| Burst Index | 2.1 | 2.0 |
| Breaking Length (km) | 3.6 | 3.5 |
| Stretch % | 2.7 | 2.7 |
| TEA J/m$^2$ | 41.9 | 39.7 |

EXAMPLE 2

Procedure

PCC is supplied to the inlet of refiner (P1) at the target ratio of hardwood wood pulp: PCC of 1:1. Thus, for each 5% SEPF addition 5% PCC was added at the refiner inlet. The resulting loaded paper pulp composition was tested to quantify the effect of filler enhanced fibrils on filler retention and sheet strength, smoothness and other characteristics for the grade.

Control condition: the control grade was produced with 5% SEPF and the usual ratio of 15% softwood:70% hardwood:15% Broke, with 12% filler. The addition point of filler will be the usual point of addition at P3, after the outlet valve to the refined pulp tank.

Trial condition: a 5% PCC filler stream was introduced into the inlet of the refiner (P1), so the ratio of unrefined wood pulp fibers:filler going to the refiner will be 1:1. This allowed for the production of the loaded paper pulp composition in the refiner at the ration of 1:1. Additional filler was added at the usual point of addition at P3, after the outlet valve to the refined pulp tank so that the total amount of filler added meets the desired percentage for the produced grade of paper. The softwood:hardwood ratio is the same as in the control condition.

Testing Protocol: The normal testing protocol for a commercial grade was followed as the efforts were made to make paper to the particular grade specifications. Initially when the PCC filler is introduced at the inlet of the refiner, samples were collected at 5-10 minute intervals and the PCC accumulation on the formed SEPF were measured to determine the steady state. It was expected that the consistency will rise after the filler addition. After a steady state is reached, samples of the formed loaded paper pulp composition (comprising SEPF and filler) were taken for SEM's and fibrillation analysis. Further samples from the refined pulp tank were taken for control and trial conditions for filler retention, and other chemical analysis. Paper samples of control and trial conditions were analyzed for complete strength profile, and ash retention. This trial demonstrated that the amount of filler used in the paper making process can be increased over conventional methods by using the loaded paper pulp composition in the process of paper making while maintaining all of the desired specifications of the end product.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow.

What is claimed is:

1. A method of making a filler-loaded pulp composition, the method comprising:

introducing wood pulp fibers and a first plurality of filler particles into one or more mechanical refiners, each of the refiner(s) comprising a pair of refiner plates that each has:

a bar width that is less than or equal to 1.3 millimeters; and a groove width that is less than or equal to 2.5 millimeters; and refining the first filler particles and wood pulp fibers with the refiner(s) until the refiner(s) consume at least 300 kilowatt-hours per ton of the wood pulp fibers, wherein the refining is performed such that (i) in each of the refiner(s) the first filler particles and wood pulp fibers are refined together and (ii) at least one of the refiner(s) operates at a specific edge load that is between 0.10 and 0.30 Watt-seconds/meter.

2. The method of claim 1, wherein the first filler particles comprise crystals of precipitated calcium carbonate (PCC).

3. The method of claim 2, wherein an average particle size of the crystals of PCC is between 0.2 and 3.0 microns.

4. The method of claim 1, wherein no binders or retention aids are included in the filler-loaded pulp composition.

5. The method of claim 1, wherein the ratio of the wood pulp fibers to the first filler particles introduced into the refiner(s) is between 1:5 and 1:1.

6. The method of claim 1, wherein the ratio of the wood pulp fibers to the first filler particles introduced into the refiner(s) is between 1:3 and 1:1.

7. The method of claim 1, wherein refining the first filler particles and wood pulp fibers is performed such that the refined wood pulp fibers have a length-weighted average fiber length that is at least 0.3 millimeters and an average hydrodynamic specific surface area that is at least 10 square meters per gram.

8. The method of claim 7, wherein refining the first filler particles and wood pulp fibers is performed such that the refined wood pulp fibers have a fiber count that is at least 12,000 fibers per milligram on an oven-dry basis.

9. The method of claim 7, wherein refining the first filler particles and wood pulp fibers is performed such that the refined wood pulp fibers have a length weighted average fiber length that is at least 0.4 millimeters and an average hydrodynamic specific surface area that is at least 12 square meters per gram.

10. The method of claim 1, wherein refining the first filler particles and wood pulp fibers is performed such that a length weighted average length of the refined wood pulp fibers is at least 60% of the original length weighted average length of the wood pulp fibers prior to refining.

11. The method of claim 10, wherein refining the first filler particles and wood pulp fibers is performed such that an average hydrodynamic specific surface area of the refined wood pulp fibers is at least 4 times greater than the average hydrodynamic specific surface area of the wood pulp fibers prior to refining.

12. The method of claim 1, wherein for at least one of the refiner(s), each of the refiner plates has a bar width that is less than or equal to 1.0 millimeters and a groove width that is less than or equal to 1.6 millimeters.

13. The method of claim 1, wherein the wood pulp fibers comprise hardwood pulp fibers.

14. The method of claim 13, wherein refining the first filler particles and wood pulp fibers is performed until the refiner(s) consume at least 400 kilowatt-hours per ton of the wood pulp fibers.

15. The method of claim 1, wherein the wood pulp fibers comprise softwood pulp fibers.

16. The method of claim 1, comprising combining the refined first filler particles and refined wood pulp fibers with a second plurality of filler particles.

17. The method of claim 16, wherein the first and second filler particles comprise calcium carbonate, talc, clay, a silica-based pigment, and/or an aluminum-based pigment.

18. The method of claim 1, where the first filler particles comprise calcium carbonate, talc, clay, a silica-based pigment, and/or an aluminum-based pigment.

19. The method of claim 1, wherein refining the first filler particles and wood pulp fibers is performed until the refiner(s) consume between 400 and 1,800 kilowatt-hours per ton of the wood pulp fibers.

* * * * *